US005346279A

United States Patent [19]

Pecorella

[11] Patent Number: 5,346,279

[45] Date of Patent: Sep. 13, 1994

[54] ORTHOPEDIC APPLIANCE

[76] Inventor: Michael N. Pecorella, 2829 Dundas St. West, Apt. #1, Toronto, Ontario, Canada, M6P 1Y6

[21] Appl. No.: 18,134

[22] Filed: Feb. 18, 1993

[51] Int. Cl.[5] ..... A47C 1/08

[52] U.S. Cl. ..... 297/256.1; 297/256.11; 297/256.13; 297/256.16

[58] Field of Search ..... 297/256.11, 256.13, 297/256.16, 250.1, 353, 440.2, 440.22, 337, 376, 344.15, 173, 174, 411.38, 130, 325, 329, 256.1

[56] References Cited

U.S. PATENT DOCUMENTS

| | | | |
|---|---|---|---|
| 818,917 | 4/1906 | Ruger | 297/173 |
| 1,434,777 | 11/1922 | Handler | 297/344.15 X |
| 1,853,848 | 4/1932 | Cross | 297/256.11 X |
| 2,549,902 | 4/1951 | Hibbard et al. | 297/376 X |
| 2,749,969 | 6/1956 | Tatter | 297/344.15 |
| 4,461,511 | 7/1984 | Berneking et al. | 297/344.15 X |
| 4,700,921 | 10/1987 | Holbrook | 297/344.15 X |
| 4,759,561 | 7/1988 | Janssen | 297/325 X |
| 4,762,364 | 8/1988 | Young | 297/256.13 X |

FOREIGN PATENT DOCUMENTS

| | | | |
|---|---|---|---|
| 3116915 | 11/1982 | Fed. Rep. of Germany | 297/173 |

*Primary Examiner*—Laurie K. Cranmer

[57] ABSTRACT

A children's orthopedic construction comprises a seating assembly, a base for the seating assembly and a tilt mechanism connecting the seating assembly and the base. The seating assembly is tiltable to different positions relative to the base and the base provides a support usable on its own for supporting the seating assembly and also being fittable with additional supports for the overall construction.

3 Claims, 4 Drawing Sheets

ORTHOPEDIC APPLIANCE

FIELD OF THE INVENTION

The present invention relates to a child's orthopedic seating construction.

BACKGROUND OF THE INVENTION

Handicapped children who are impaired either mentally or physically require endless hours of care and attention. From birth through their very early years of for example, three to four years of age, i.e. their formative years, they may often spend much of their time in some type of an orthopedic seating system. It is therefore important that an orthopedic seating system is designed to meet the needs of an impaired child and further that it assists as much as possible in the development of the child. It is also important because of the cost associated with a child's orthopedic seating system that the system must be capable of handling a child at a very early age and grow with the child.

As is the case with all infants, a handicapped child will typically be fed in a somewhat reclining position. An upright position is more acceptable to enable the child to play and even for purposes of teaching the child different types of body skills. An orthopedic chair is required to meet these as well as other needs.

SUMMARY OF THE INVENTION

The present invention provides a child's orthopedic construction comprising a seating assembly formed by a seat back and a seat bottom and the construction further includes a base for the seating assembly with a tilt mechanism connecting the seating assembly with the base. The seating assembly is tiltable to different positions relative to the base and the seat back is reclineable relative to the seat bottom. The base provides a support useable on its own for supporting the seating assembly and is also fittable with additional supports for the construction.

As a result of the above construction, a child in the seating assembly can either be tilted or reclined from a generally upright to a more laid back position and back to the upright position without having to adjust the support base. The seating assembly along with its base is easily carried from one location to another and the base can quickly and easily be attached to different types of support structures. This makes the overall construction extremely stable and also very easy to handle by one person without having to remove the child from the seating assembly.

BRIEF DESCRIPTION OF THE DRAWINGS

The above as well as other advantages and features of the present invention will be described in greater detail according to the preferred embodiments of the present invention in which;

FIG. 4 is a front perspective view of the seating assembly of FIG. 1 when fitted with orthopedic cushioning.

Figure 1:
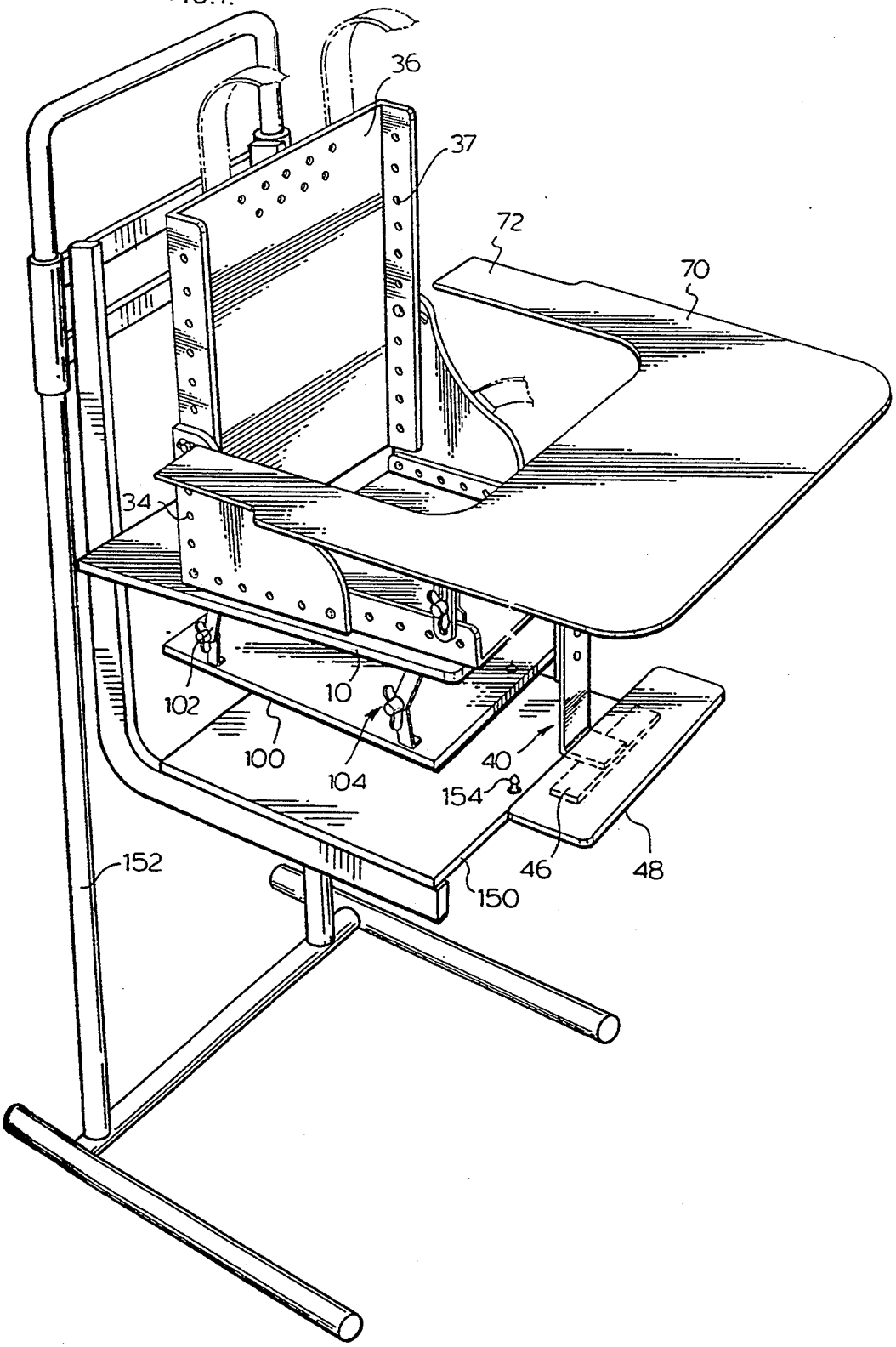
FIG. 1 is a front perspective view of an orthopedic construction according to a preferred embodiment of the present invention.
Figure 2:
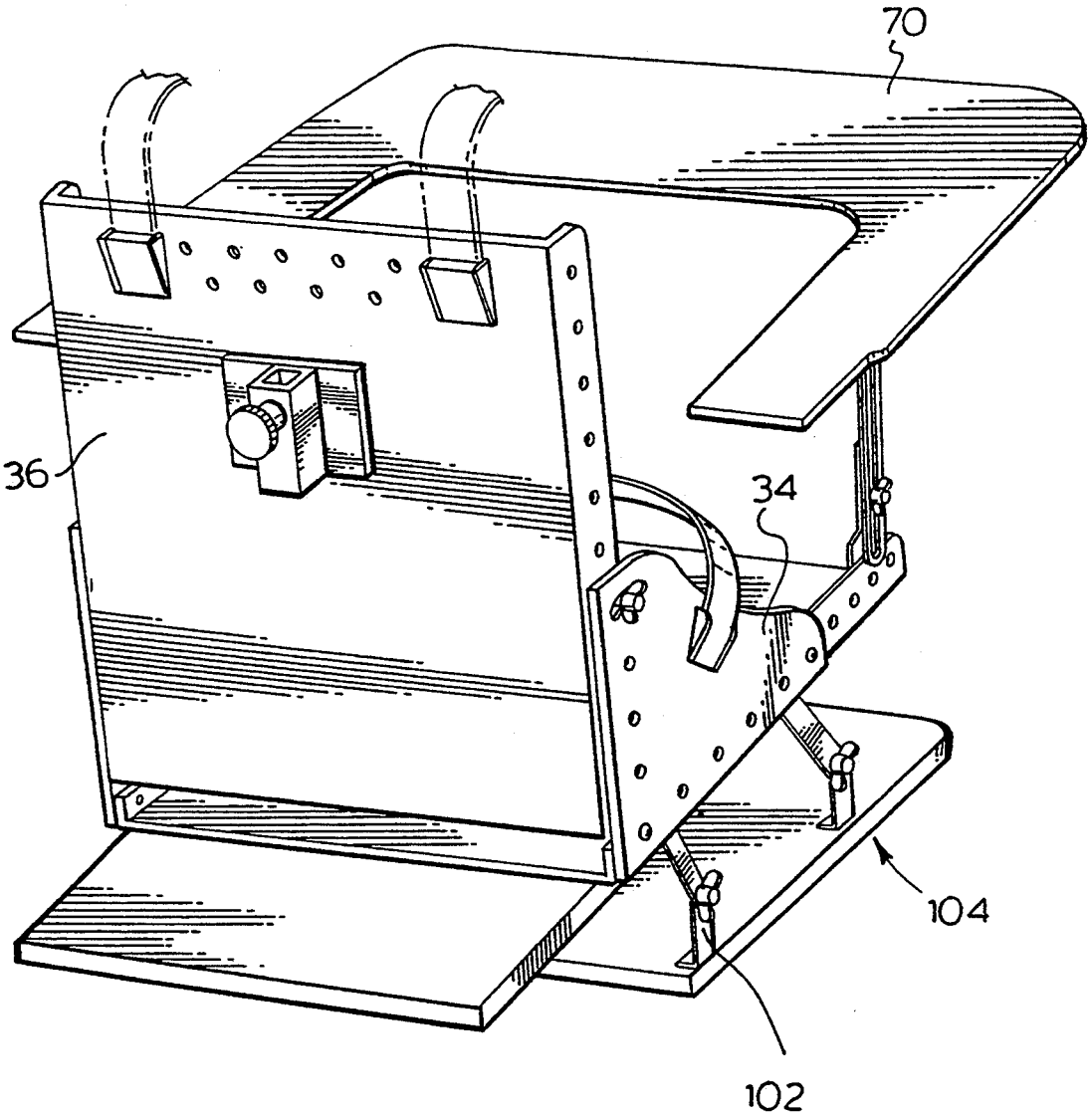
FIG. 2 is a rear perspective view of the orthopedic construction of FIG. 1.

DETAILED DESCRIPTION ACCORDING TO THE PREFERRED EMBODIMENTS OF THE PRESENT INVENTION

The orthopedic construction of the invention includes a plate 10 which is removably attached to a support which is stationary or movable by means described below.

The plate 10, adjacent the rear edge 12 has two spaced apart arms 14 on the upper side, each arm being secured by heads 16 of screws passing through a slot 20 into the plate 10. Each arm 14, in a direction away from the rear edge 12 of the plate 10, has raised portion 22 with respect to the surface of the plate 10.

Figure 3:
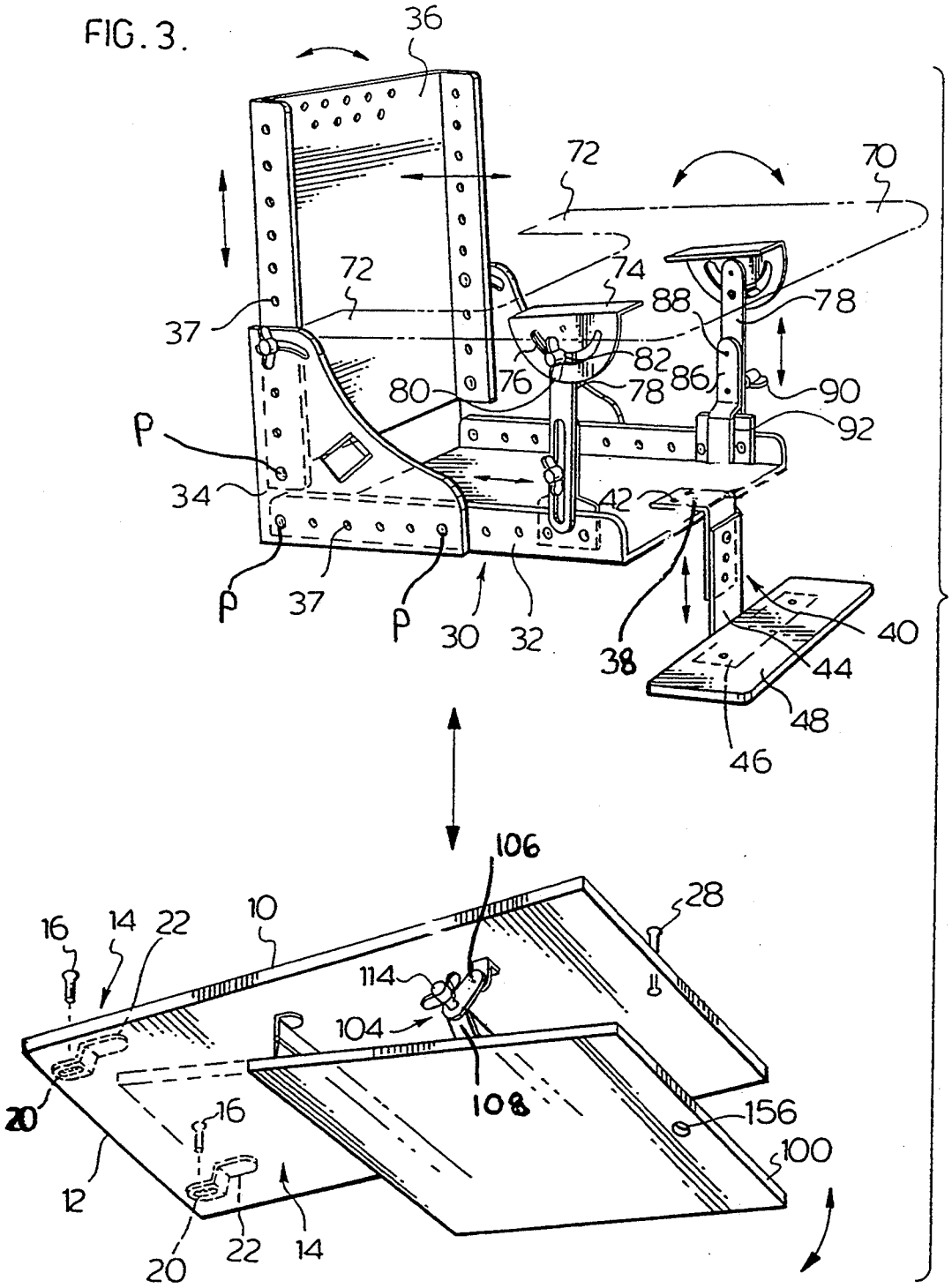
FIG. 3 is an exploded perspective view of the orthopedic construction of FIG. 1.

Adjacent the opposite front edge of the plate 10 is a fixed upstanding pin with a slightly enlarged head 28. Surmounting the plate 10 is another plate 30 which constitutes a seat bottom. The raised portions 22 of arms 14 fit over the seat bottom to releasably secure the seating assembly to plate 10. The plate 30 has opposed side flanges 32, opposed side reinforcing members 34 and is connected to a seat back 36. The seat bottom and seat back have a series of holes 37 which align with holes in side members 34 to receive locking pins P as shown in FIG. 3. This is not new subject matter added to the application but rather is simply a written expression of what is shown in FIG. 3, which makes the assembly capable of adjustment in both height and length to accommodate various children and child growth.

At the forward mid portion of the seat 30, one arm 38 of a right angled bracket 40 is secured by screws 42 to the seat bottom 30. The other arm 44 of the bracket 40 depends downwardly exterior of the seat bottom. A plate 46 is attached to the outward face of the arm 44 and the plate 46 supports in fixed relationship a foot rest 48.

Disposed above the plate 30 in spaced relationship thereto is a tray 70 having a conventional convex edge which terminates at each side in an extension 72 designed to confine the occupant of the seat in place.

Secured to the underside of the tray is a cross member to which is secured a pair of spaced apart, right angled brackets, each generally denoted by the numeral 74, one of which will now be described. The upper arm of the bracket provides for securement to the tray and the depending arm has an arcuate slot 76. A support member 78 is pivoted at the upper end to the arcuate slotted arm at a position above the slot. The member has a longitudinal slot 80 commencing at a point below the arcuate slotted member. Below the pivot and traversing the member and the arcuate slot is a hand operable tightening member 82 which fixes the relative positions of the two members already described to thus maintain the selected tilt of the tray. A further hand operable tightening member 90 secures through the slot 80 in member 78 into one of the openings 88 of member 86 which maintains the height of the tray.

Member 86 provides a support for member 78 and fits down into the pocket 92 to attach the tray to the seat bottom.

Positioned below the first plate 10 is another or third plate 100, the two being hinged at the rear by a first lateral hinge 102. Forward thereof is another or second lateral hinge construction generally denoted by the numeral 104, and having a greater distance of adjustment than the first lateral hinge. The purpose of the two lateral hinges is to vary the distance between the first and third plates, thereby tilting the seat as desired. The forward or second hinge construction 104 comprises two arms 106 and 108 secured to the first and third plate as shown. Each arm where it is hinged to the other is provided with a ratchet. A manually operable handle 114 is rotated to release and tighten the ratchet engagement between arms 106 and 108 and to maintain the seat 30 in any desired tilt. A similar hinge arrangement is found at hinge 102.

Figure 4:
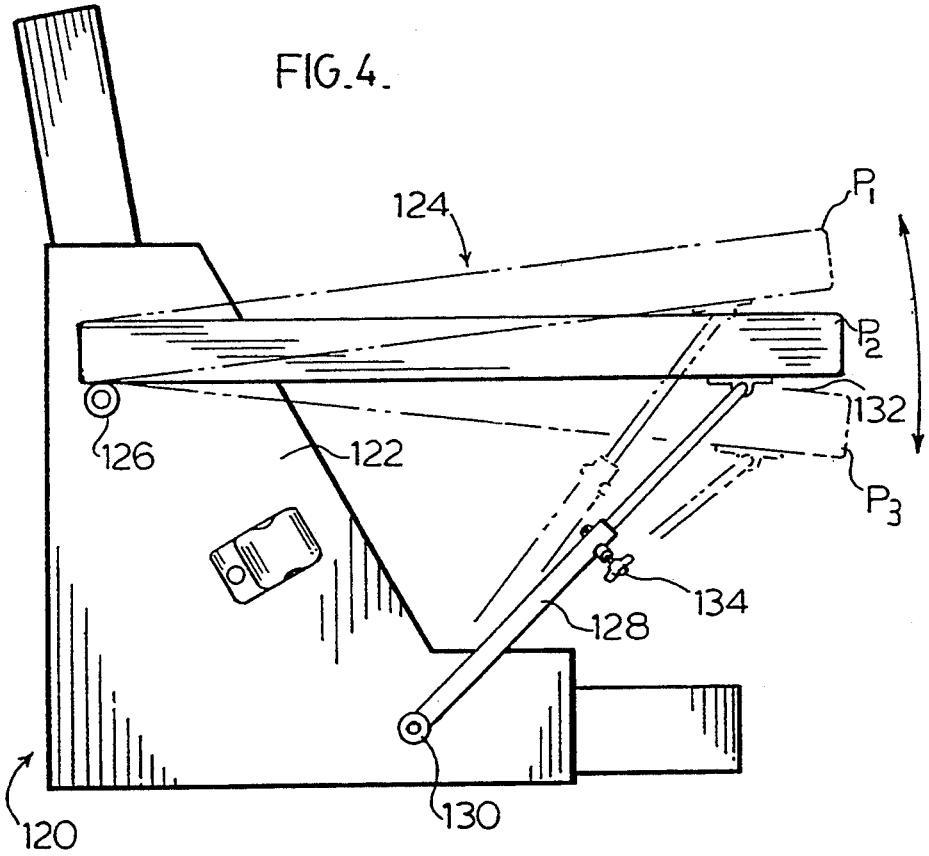
FIG. 4 is a side view of a seating assembly including a modified tray support from that shown in FIGS. 1 through 3 of the drawings.

FIG. 4 of the drawings shows an orthopedic seating assembly generally indicated at 120 which is identical in construction to the seating assembly described above except for the tray design. In this particular case, the tray generally indicated at 124 has a pivot connection 126 to the side plate 122 of the chair at the inner end of the tray and a further pivot connection 132 at the outer end of the tray. An extendable or telescopic rod 128 extends between pivot connection 132 at the outer end of the tray and a further pivot connection 130 connected back to the side plate 122. A tensioning member 134 is provided on rod 128 for holding adjusted lengths of the rod as shown in FIG. 4.

In the earlier description the seating assembly comprises the seat back 36 and the seat bottom 30 which are tiltable relative to the base plate 100 which in combination with plate 10 provides the bottom support for the seating assembly. This is referred to as a tilt in space movement of the seat where the seat back and the seat bottom tilt as a single unit relative to the support base. The tilt in space movement is to be distinguished from a reclining motion where the angle of the seat back is changed relative to the seat bottom which is also provided in the seating assembly.

It is important when the seating assembly is tilted in space to have the ability to maintain the tray in a horizontal position. FIG. 4 shows three positions for tray 124 and designated at P1, P2 and P3. Position P2 is appropriate for a flat positioning of the tray when seating seating assembly 120 is in the FIG. 4 position. However, if seating assembly 120 were tilted rearwardly from the FIG. 4 position, tray position P3 would be required in order for the tray to remain level. On the other hand, if seating assembly 120 were tilted more farther forward than what is shown in FIG. 4, tray position P1 would be required to maintain a flat tray position. As can be well understood from FIG. 4, these as well as other tray positions are quickly and easily accommodated by a very simple adjustment of the length of rod 128. Furthermore, it will be seen in FIG. 4 that regardless of the position to which the tray is adjusted, the inner end 127 of the tray never varies in height relative to the seat bottom of the seating assembly. Accordingly, a child sitting in seating assembly 120 will always have his or her elbows at the same height, which in this case, has been set for most efficient use of the child's hands and arms for developing different motor skills.

FIGS. 1 through 4 show the external frame for the orthopedic construction. This frame is then completed with a padded interior as shown for example in FIG. 5 of the drawings.

Figure 5:
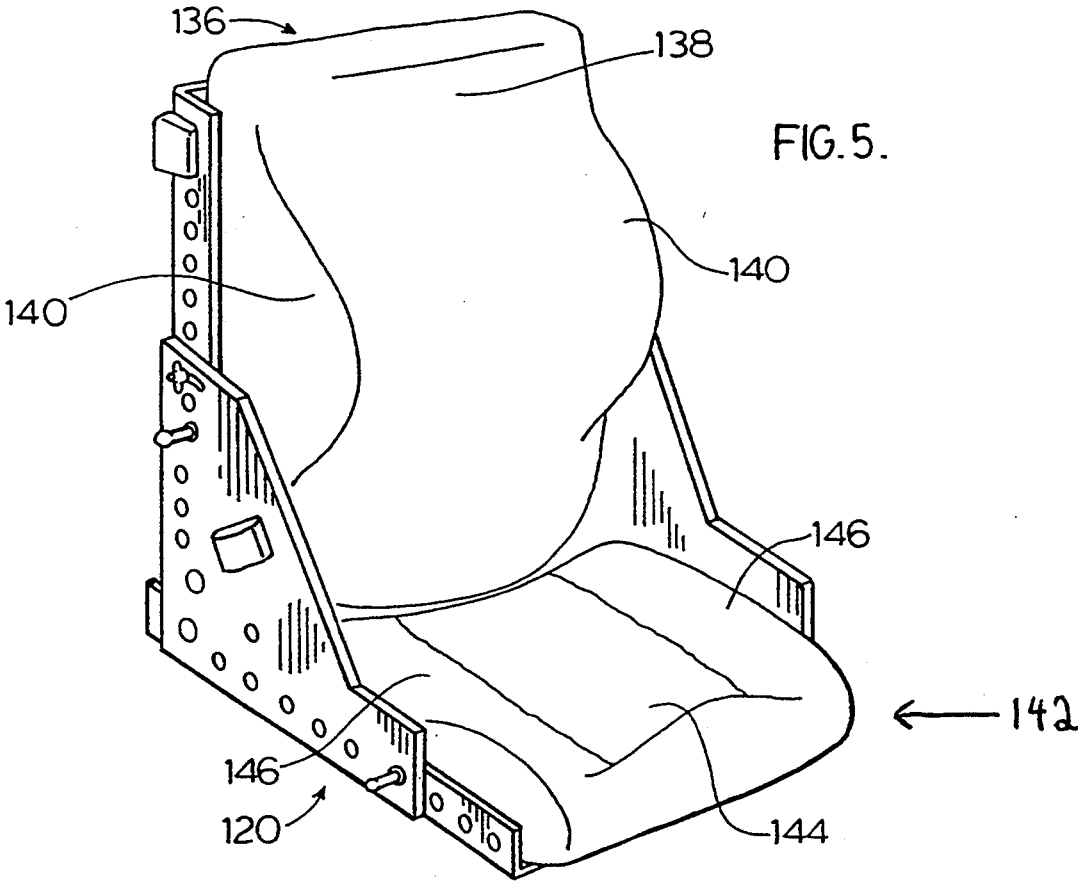

It is becoming more and more recognized that in working with handicapped children, it is important to bring them as much as possible to a mid-line position. This term, which is known in the industry, essentially means that the child's limbs should be centered as much as possible about the torso. In the case of an impaired child, it may often be difficult for the child to do this by himself and therefore, it is important that artificial aids be used to assist in developing and maintaining a mid-line position which then allows the child to concentrate on development of his or her motor skills. The padded interior of the seating assembly shown in FIG. 5 is specifically designed for mid-lining purposes.

More particularly, the seating frame assembly 120 identical to that shown in FIG. 4 is provided with a back pad generally indicated at 136 and a seat pad generally indicated at 142. Back pad 136 includes a centrally depressed or hollowed region 138 with raised exterior pad portions 140 to opposite sides of the back pad. These raised portions provide a positioning guide aiding a child sitting in the seating assembly to keep his or her arms and hands in a mid-line position in front of the child atop the tray. This in combination with the appropriate elbow positioning on the tray maximizes the child's ability to learn how to properly use his or her arms and hands.

Seat cushion 142 has a centrally hollowed region 144 and raised outer side regions 146. This configuration, like the back pad brings the child's legs and feet to a mid-line position relative to the torso.

Although not shown, the seating assembly can be provided with a padded head rest where the pads on the head rest are once again contoured to have a central recessing and outer side protuberances which urge the child to maintain his or her head in a mid-line position with the body.

Returning to the FIG. 1 through 3 description of the drawings, it is to be understood that the seating assembly comprising the seat back and the seat bottom can quickly and easily be detached from the base support which comprises not only plate 100 but in addition, plate 10. This is achieved through a quick connect, disconnect release mechanism. Accordingly, the seating assembly can be moved to different locations either with or without the base support for the seating assembly. The base support when released from the seating assembly lightens weight of the load and, a number of base supports, identical to the base support comprising plates 10 and 100 may be set up in different locations. The seating assembly can be fitted to any one of those base supports.

As an alternative, the seating assembly, may be carried from place to place with the base attached and although the base is capable on its own of supporting the seating assembly, it may also be secured to further supporting structures. FIG. 1 shows a particular arrangement in which an upright chair frame 152 is provided with a support plate 150. Plate 150, which is specifically designed to receive the seating assembly with its base includes an upright post 154 while the base plate 100 as shown in FIG. 3 of the drawings, includes a bottom opening 156 designed to fit over the post 154 of plate 150. In addition, plate 100 is provided with a quick connect coupler to allow a quick release positive connection between plate 100 and plate 150.

Again, it is to be appreciated that different devices such as high chairs, strollers, etc. can be fitted with further plates identical to plate 150 to which base plate 100 quickly and easily attaches.

From the above description, it will now be seen how a child's orthopedic construction of the present invention is extremely effective and versatile in use. It has not only tilt in space ability but in addition includes recline features. When fitted with proper padding, the construction has mid-line features. It can be carried in various different degrees of assembly either with or without its base and can be attached to different bases or different support structures for the base.

In addition, the seating assembly itself is provided with adjustment features which allow not only height adjustment of the seat back, but in addition, front to back depth adjustment of the seat bottom of the seating assembly. The size adjustment of the seating assembly allows it to grow with the child and is particularly designed to receive children from infancy to typically an age of about three to four years.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A child-fitting orthopedic construction of a size easily carried by a guardian of a child using said construction, said construction having size adjustment features accommodating child growth and comprising a seating assembly formed by a seat bottom which is horizontally adjustable to vary front to back depth of said seating assembly and a seat back which is vertically adjustable to vary height of said seating assembly, said seat bottom and said seat back being adjustably secured relative to one another by seat adjustment means comprising a plurality of locking positions with adjacent locking positions being separated from one another by intervening material which blocks slippage between the adjacent locking positions, said construction further comprising a base having a horizontal bottom base portion and a tilt mechanism between said horizontal bottom base portion and said seating assembly, said base comprising both an independent support in one mode of use of said construction and an attachment piece to an auxiliary support in another mode of use of said construction.

2. A children's orthopedic seating construction specifically sized to be manually carried by a guardian of child using said construction, said construction having size adjustment features which accommodate child growth and comprising a seating assembly formed by a horizontally adjustable seat bottom, a vertically adjustable seat back and opposing vertical side plates to which said seat bottom and said seat back are secured by releasable interlock means, said releasable interlock means comprising a series of spaced apart openings on each of said seat bottom, seat back and side plates and connectors which fit in an interlocking position through aligned ones of said openings in said seat bottom and said side plates and through aligned ones of said openings in said seat back and said side plates and said interlock means only being size adjustable when said connectors are removed from said openings, said construction further having a horizontal base portion and a tilt mechanism between said seating assembly and said horizontal base portion, said horizontal base portion comprising both an independent support in one mode of use of said construction and an interfere with a seat of an auxiliary support larger than said construction in another mode of use of said construction.

3. A child-fitting orthopedic construction as claimed in claim 1 including a tray having an outer and an inner end, said inner end of said tray being mounted to said construction by pivotal connections on opposite sides of said tray and said outer end of said tray being connected to said construction by length adjustable rods pivotally connected at opposite ends to said tray and said seating assembly to provide adjustable tilt positions of said tray on said construction.

* * * * *